US008062441B2

(12) United States Patent
Rokutanda et al.

(10) Patent No.: US 8,062,441 B2
(45) Date of Patent: Nov. 22, 2011

(54) HIGH HARDNESS, HIGH CORROSION RESISTANCE AND HIGH WEAR RESISTANCE ALLOY

(75) Inventors: Takashi Rokutanda, Yokohama (JP); Tomohisa Arai, Yokohama (JP); Takao Kusaka, Yokohama (JP); Nobuyoshi Jimbo, Odawara (JP)

(73) Assignees: Kabushiki Kaisha Toshiba, Tokyo (JP); Toshiba Materials Co., Ltd., Kanagawa-ken (JP)

( * ) Notice: Subject to any disclaimer, the term of this patent is extended or adjusted under 35 U.S.C. 154(b) by 327 days.

(21) Appl. No.: 11/664,275

(22) PCT Filed: Sep. 22, 2005

(86) PCT No.: PCT/JP2005/017488

§ 371 (c)(1),
(2), (4) Date: Mar. 30, 2007

(87) PCT Pub. No.: WO2006/035671

PCT Pub. Date: Apr. 6, 2006

(65) Prior Publication Data

US 2008/0121319 A1 May 29, 2008

(30) Foreign Application Priority Data

Sep. 30, 2004 (JP) ..... 2004-288964

(51) Int. Cl.
*C22F 1/10* (2006.01)

(52) U.S. Cl. ..... 148/677

(58) Field of Classification Search ..... 148/400, 148/428, 405, 410, 95, 559, 675–677; 420/441, 420/445–450

See application file for complete search history.

(56) References Cited

U.S. PATENT DOCUMENTS 3,015,558 A * 1/1962 Grant et al. ..... 420/445

(Continued)

FOREIGN PATENT DOCUMENTS

JP 63-18031 4/1988

(Continued)

OTHER PUBLICATIONS

International Preliminary Report on Patentability and Written Opinion issued by the International Bureau of WIPO dated Apr. 12, 2007.

(Continued)

*Primary Examiner* — Scott Kastler
*Assistant Examiner* — Vanessa Velasquez
(74) *Attorney, Agent, or Firm* — Finnegan, Henderson, Farabow, Garrett & Dunner, L.L.P.

(57) ABSTRACT

There are provided a high hardness, high corrosion resistance and high wear resistance alloy, wherein the alloy is an aging heat treated Cr(chromium)-Al(aluminum)-Ni(nickel)-base alloy, the proportion of a mixed phase of (α phase+γ' phase+γ phase) precipitated at grain boundaries of γ phase grains in a metal structure in the cross section of the alloy is not less than 95% in terms of area ratio, and the intensity ratio as measured by X-ray diffractometry of the alloy is not less than 50% and not more than 200% in terms of Iα(110)/[Iγ(200)+Iγ'(004)]×100, and a component comprising this alloy, a material for an alloy which can form this alloy, and a process for producing this alloy. The present invention can provide a Cr—Al—Ni-base alloy possessing excellent corrosion resistance, hardness, wear resistance, releasability, fatigue strength, and planishing property in a molding face, a component comprising this alloy, a material for an alloy which can form this alloy, and a process for producing this alloy.

1 Claim, 7 Drawing Sheets

U.S. PATENT DOCUMENTS

2005/0167010 A1* 8/2005 Arai et al. ..... 148/428

FOREIGN PATENT DOCUMENTS

| | | |
|---|---|---|
| JP | 7-8540 | 1/1995 |
| JP | 2001-62594 | 3/2001 |
| JP | 2001-62595 | 3/2001 |
| JP | 2002-88431 | 3/2002 |
| WO | WO 03/097887 A1 | 11/2003 |

OTHER PUBLICATIONS

Materia Japan (a bulletin of The Japan Institute of Metals), vol. 22, No. 4, pp. 323-325, (date: 1983).

* cited by examiner

HIGH HARDNESS, HIGH CORROSION RESISTANCE AND HIGH WEAR RESISTANCE ALLOY

TECHNICAL FIELD

The present invention is directed to a high hardness, high corrosion resistance and high wear resistance alloy. More specifically, the present invention is directed to a high hardness and high corrosion resistance alloy, which is particularly suitable for use under an environment in which corrosive materials such as acids, alkalis, and salts are present, a component comprising this alloy, a material for an alloy, which can form this alloy, and a process for producing this alloy.

BACKGROUND ART

In compression molding a raw material such as powder or granules into tablets of pharmaceuticals, quasi-drugs, cosmetics, agricultural chemicals, feeds, foods or the like, a mold comprising a combination of a mortar having through-holes corresponding to the shape of tablets with a lower pestle and an upper pestle to be inserted into the through-holes (mortar holes) has hitherto been used. In a tablet molding machine using the above mold, a raw material such as powder is filled into the mortar into which the lower pestle has been inserted, and the raw material is compressed by the upper pestle for molding into desired tablets.

As described, for example, in Japanese Patent Laid-Open No. 8540/1995, for example, iron-base alloys such as alloy tool steels, for example, SKS2 and SKD11, or cemented carbide alloys composed mainly of compounds of Mo (molybdenum), W (tungsten) and the like have hitherto been adopted in molds used, for example, in tablet molding machines.

Further, in order to improve corrosion resistance of molds such as alloy tool steels, an attempt has also been made to coat the surface with a chromium plating. However, satisfactory effect cannot be attained due to the separation of the plating layer. The chromium plating layer can have a given effect for an improvement, for example, in surface hardness. Since, however, the chromium plating layer per se is disadvantageously easily separated, satisfactory and stable wear resistance improvement effects and the like cannot be attained. This has led to a demand for an improvement, for example, in corrosion resistance and wear resistance while maintaining strength and hardness of the member for a mold.

In order to solve the problem of wear resistance, Japanese Patent Laid-Open No. 62595/2001 describes high hardness and high corrosion resistance tablet molding pestle and mortar. This alloy has high hardness and high corrosion resistance and, at the same time, has releasability. Although this alloy can maintain good releasability for approximately a few hours immediately after tablet molding, a further improvement in releasability has been desired for mass production purposes. Further, since this alloy has a relatively low fatigue strength, an increase in strength has been desired, and, in addition, the possession of a planishing property of the molding face has also been desired.

On the other hand, applications in which corrosion resistance is required include not only manufacturing equipment such as the above-described mold for corrosive powder but also processing equipment for chemicals, processing equipment for waste liquids or waste sludge, combustion apparatuses, and their peripheral components. Further, corrosion resistant steels such as stainless steels have been used in applications where corrosion resistance is mainly required, for example, molds for resin lenses or engineering plastics or other resins, and components such as cutting tools and direct acting bearings. Corrosion resistant steels such as stainless steels, however, are unsatisfactory, for example, in strength and hardness and, thus, cannot be used in applications where hardness and wear resistance are particularly required.

For example, Japanese Patent Laid-Open No. 18031/1988 describes a high corrosion resistance hot pressing mold comprising 20 to 50% by mass of Cr (chromium) and 1.5 to 9% by mass of Al (aluminum) with the balance consisting essentially of Ni (nickel). This hot pressing mold has such properties that it exhibits high hardness against hot pressing under conditions of temperature 500 to 800° C. and pressing pressure 500 to 2000 kg/cm$^2$ (50 to 200 MPa) and has buckling resistance. Further, the mold has been found to have corrosion resistance against Ni and Cr. So far as the present inventors know, however, this mold component of an Ni—Cr—Al-base alloy possesses excellent material hardness and corrosion resistance, but on the other hand, the wear resistance is not always satisfactory and, for some service conditions, wear progresses in a sliding part of the component, disadvantageously leading to shortened component service life.

Good planishing properties are required of molds for resin lenses and resins such as the so-called "engineering plastics." Since, however, the conventional steel product is an alloy which is hardened by a relatively large precipitated carbide, pores are formed due to falling of precipitated carbide particles during polishing and, in addition, damage to the polished surface by fallen particles, making it difficult to conduct planishing. Further, in the conventional steel material, Ni plating or CrN coating is carried out for releasability improvement purposes. The conventional steel material, however, is disadvantageous in that the releasability is not satisfactory, the releasability is deteriorated depending upon surface roughness, and the releasability varies depending upon wear.

In order to improve the wear resistance, Japanese Patent Laid-Open No. 88431/2002 describes a member comprising a case hardened layer provided on this Ni—Cr—Al-base alloy. A further improvement in releasability, an improvement in fatigue strength, and an improvement in planishing properties of the molding face have been desired. In particular, molds for resin molding had a serious problem involved in the production thereof associated with releasability that the molding resin is likely to adhere to the mold.

The realization of a homogeneous metal structure is desired for improving the releasability, the fatigue strength, and the planishing property of the molding face. That is, when an unaged structure is present, in molding powder or the like, the powder is cut into the unaged soft phase and the amount of the powder adhered is gradually increased, resulting in deteriorated releasability. Further, since the unaged soft layer is present, the fatigue strength is lowered. Furthermore, there is a tendency that a difference in hardness between the aging precipitated phase and the unaged phase affects polishing and causes a difference in polishing between the aging precipitated phase and the unaged phase, leading to a tendency that planishing becomes difficult. As reported in Materia Japan (a bulletin of The Japan Institute of Metals), Vol. 22, No. 4, p. 323, in the precipitated phase of this alloy system after aging treatment, a $\gamma$ phase is composite precipitated in a thin layer form at boundaries between the layered $\alpha$ phase and $\gamma$ matrix phase to form a characteristic three-layer structure of $\alpha$, $\gamma'$, and $\gamma$ parent phases. In this conventional production process of this alloy, even after aging heat treatment at a proper temperature of 650° C. to 800° C., a certain level of an unaged $\gamma$ phase stays, and, thus, a complete three-phase ($\alpha$, $\gamma'$, and $\gamma$) structure cannot be realized.

Accordingly, in order to improve the releasability, fatigue strength, and the planishing property of the molding face, a reduction in unaged phase and homogeneous refinement have been desired. Further, stable precipitation of three phases ($\alpha$, $\gamma'$, and $\gamma$) in the aged structure has also been desired.

Patent document 1: Japanese Patent Laid-Open No. 62595/2001

Patent document 2: Japanese Patent Laid-Open No. 18031/1988

Patent document 3: Japanese Patent Laid-Open No. 88431/2002

Non-patent document 1: Materia Japan (a bulletin of The Japan Institute of Metals), Vol. 22, No. 4, p. 323

DISCLOSURE OF THE INVENTION

Problems to be Solved by the Invention

The present invention has been made with a view to solving the above problems of the prior art, and an object of the present invention is to provide an alloy for a mold for resin molding that has improved releasability, fatigue strength, and planishing property of the molding face while maintaining strength required of the mold for press molding of powder, plastics or the like and corrosion resistance against corrosive materials such as acidic powder, and to provide a mold component for a mold for resin molding.

Means for Solving the Problems

The above object can be attained as follows.

According to the present invention, there is provided a high hardness, high corrosion resistance and high wear resistance alloy, wherein said alloy is a Cr(chromium)-Al(aluminum)-Ni(nickel)-base alloy, the proportion of a mixed phase of ($\alpha$ phase+$\gamma$ phase+$\gamma$ phase) precipitated at grain boundaries of $\gamma$ phase grains in a metal structure in the cross section of the alloy is not less than 95% in terms of area ratio, and the intensity ratio as measured by X-ray diffractometry of the alloy is not less than 50% and not more than 200% in terms of $I\alpha(110)/[I\gamma(200)+I\gamma'(004)]\times100$.

In a preferred embodiment of the present invention, the high hardness, high corrosion resistance and high wear resistance alloy according to the present invention satisfies requirements that:

(i) the average grain diameter (D) of unaged $\gamma$ phase is not more than 500 μm; and (ii) the total length of the average grain diameter (D) of unaged $\gamma$ phase and the average precipitation width (W) of the mixed phase of ($\alpha$ phase+$\gamma$ phase+$\gamma$ phase) precipitated at the grain boundaries is not more than 2 mm.

In a preferred embodiment of the present invention, the high hardness, high corrosion resistance and high wear resistance alloy according to the present invention comprises not less than 25% by weight and not more than 60% by weight of Cr (chromium) and not less than 1% by weight and not more than 10% by weight of Al (aluminum) with the balance consisting of Ni (nickel), trace elements and incidental impurities.

In a further preferred embodiment of the present invention, the high hardness, high corrosion resistance and high wear resistance alloy according to the present invention comprises not less than 30% by weight and not more than 45% by weight of Cr (chromium) and not less than 2% by weight and not more than 6% by weight of Al (aluminum) with the balance consisting of Ni (nickel), trace elements and incidental impurities.

In a preferred embodiment of the present invention, in the high hardness, high corrosion resistance and high wear resistance alloy according to the present invention, a part of Cr has been replaced with at least one element selected from Zr (zirconium), Hf (hafnium), V (vanadium), Ta (tantalum), Mo (molybdenum), W (tungsten), and Nb (niobium), provided that the total amount of replacement of Zr, Hf, V, and Nb is not more than 1% by weight, the amount of replacement of Ta is not more than 2% by weight, and the total amount of replacement of Mo and W is not more than 10% by weight.

Further, according to the present invention, there is provided a high hardness, high corrosion resistance and high wear resistance component formed of the above alloy according to the present invention.

Furthermore, according to the present invention, there is provided a material for a high hardness, high corrosion resistance and high wear resistance alloy which can form an alloy according to the present invention by subjecting the material to aging heat treatment.

Furthermore, according to the present invention, there is provided a material for a high hardness, high corrosion resistance and high wear resistance alloy according to the present invention, wherein said material is a solution treated material having such properties that the intensity ratio as measured by X-ray diffractometry is not more than 5% in terms of $I\gamma'(110)/[I\gamma'(110)+I\alpha(110)+I\gamma(200)+I\gamma'(004)]\times100$ and is not more than 5% in terms of $I\alpha(110)/[I\gamma'(110)+I\alpha(110)+I\gamma(200)+I\gamma'(004)]\times100$, and the grain diameter is not more than 5 mm.

Furthermore, according to a present invention, there is provided a process for producing a high hardness, high corrosion resistance and high wear resistance alloy, said process comprising subjecting the above material for an alloy according to the present invention to aging heat treatment.

In a preferred embodiment of the present invention, in the process for producing a high hardness, high corrosion resistance and high wear resistance alloy according to the present invention, the aging heat treatment is carried out at 500 to 850° C.

In a preferred embodiment of the present invention, in the process for producing a high hardness, high corrosion resistance and high wear resistance alloy according to the present invention, prior to the aging heat treatment, said material is subjected to (i) pretreatment heating in which the material is heated to 400 to 700° C. at a temperature rise rate of not less than 100° C./hr and not more than 500° C./hr and (ii) pretreatment heating in which the material is held in a temperature range of 400 to 500° C. for at least 0.5 hr.

Effect of the Invention

The present invention can provide a high hardness, high corrosion resistance and high wear resistance alloy that has excellent corrosion resistance, hardness, and wear resistance and, at the same time, has releasability, fatigue strength, and planishing property of the molding face.

The alloy according to the present invention can be utilized in various applications by taking advantage of such excellent properties, for example, is usable in the field of pharmaceuticals and resin molding in which, even after use for a long period of time in a corrosive environment under high temperature and high pressure conditions, the level of deformation and wear should be low and the releasability should also be excellent.

BEST MODE FOR CARRYING OUT THE INVENTION

Figure 1:
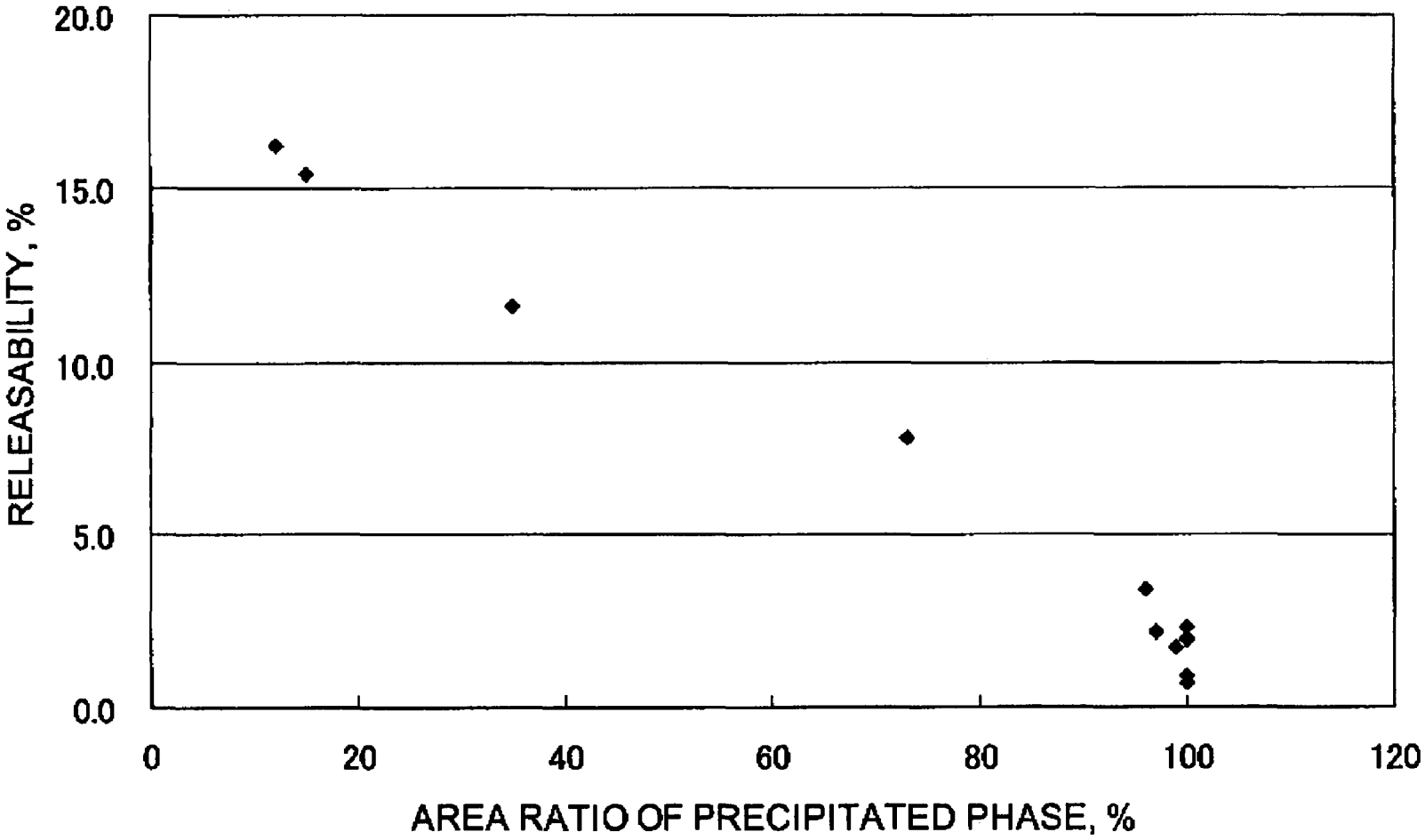
FIG. 1 A diagram showing the relationship between the area ratio of a mixed phase of ($\alpha$ phase+$\gamma$ phase+$\gamma$ phase) in an alloy and the releasability.

The mode for carrying out the invention will be described.

<High Hardness, High Corrosion Resistance and High Wear Resistance Alloy>

It is generally observed that, in a solution treated Cr—Al—Ni-base alloy, as aging heat treatment progresses, a mixed phase of (α phase+γ phase+γ phase) [that is, a mixed phase composed of α phase, γ phase, and γ phase] is precipitated at boundaries of γ phase grains and, at the same time, the unaged γ phase part is gradually reduced.

The high hardness, high corrosion resistance and high wear resistance alloy according to the present invention is a Cr(chromium)-Al(aluminum)-Ni(nickel)-base alloy subjected to such aging heat treatment, wherein the proportion of a mixed phase of (α phase+γ phase+γ phase) precipitated at grain boundaries of γ phase grains in a metal structure in the cross section of the alloy is not less than 95% in terms of area ratio, and the intensity ratio as measured by X-ray diffractometry of the alloy is not less than 50% and not more than 200% in terms of $I\alpha(110)/[I\gamma(200)+I\gamma'(004)]\times100$.

In the present invention, the proportion of the mixed phase of (α phase+γ phase+γ phase) is not less than 95%, preferably not less than 98%, particularly preferably 100%, in terms of area ratio. When the proportion of the mixed phase of (α phase+γ phase+γ phase) is less than 95% in terms of area ratio, the homogeneity of the structure is lowered and, thus, the object of the present invention cannot be attained. It is needless to say that the high hardness, high corrosion resistance and high wear resistance alloy according to the present invention embraces an alloy consisting essentially of a mixed phase of (α phase+γ' phase+γ phase) (that is, an alloy in which the proportion of the mixed phase of (α phase+γ phase+γ phase) is 100% in terms of area ratio).

In the high hardness, high corrosion resistance and high wear resistance alloy according to the present invention, the intensity ratio for the alloy as measured by X-ray diffractometry is not less than 50% and not more than 200%, preferably not less than 70% and not more than 200%, particularly preferably not less than 100% and not more than 200%, in terms of $I\alpha(110)/[I\gamma(200)+I\gamma'(004)]\times100$. When the intensity ratio is outside the above-defined range, the object of the present invention cannot be attained.

In this connection, it should be noted that γ(111) or γ'(112) peak as a main peak was excluded, because the peak is located near an α(110) peak and thus cannot be separated and cannot be subjected to determination of the intensity ratio without difficulties, or is likely to cause errors.

Among the high hardness, high corrosion resistance and high wear resistance alloys according to the present invention specified above, those satisfying the following requirements (i) and (ii) are particularly preferred:

(i) the average grain diameter (D) of unaged γ phase is not more than 500 μm; and (ii) the total length of the average grain diameter (D) of unaged γ phase and the average precipitation width (W) of the mixed phase of (α phase+γ phase+γ phase) precipitated at the grain boundaries is not more than 2 mm.

In requirement (i), the expression "the average grain diameter (D) of the unaged γ phase" means "the average value of the maximum grain diameter of unaged γ phase grains surrounded by a mixed phase of (α phase+γ phase+γ phase) in metal crystal grains." Incidentally, when the presence of "unaged γ phase" is not substantially observed, the "average grain diameter (D) of the unaged γ phase" is "0 μm."

In requirement (ii), the expression "the average precipitation width (W) of a mixed phase of (α phase+γ phase+γ phase) precipitated at grain boundaries" means "the average value of the shortest distance between an unaged γ phase grain present in one metal crystal grain and another unaged γ phase grain present in another metal crystal grain adjacent to this metal crystal grain." When the presence of the "unaged γ phase" is not substantially observed, for convenience, it is regarded that an unaged γ phase is present in the position of the center of gravity in the crystal grain. Accordingly, in such a case, the "average value" of the distance between the positions of the center of gravity in adjacent metal crystals is regarded as the average precipitation width (W) of the mixed phase of (α phase+γ phase+γ phase) precipitated at the grain boundaries.

The total length of the average grain diameter (D) of the unaged γ phase and the average precipitation width (W) of the mixed phase of (α phase+γ phase+γ phase) precipitated at the grain boundaries (hereinafter often referred to herein as "D+W") is not more than 2 mm, preferably not more than 1 mm. When the total length of the average grain diameter (D) and the average precipitation width (W) (that is, "D+W") exceeds 2 mm, the unaged part is likely to stay and, thus, the object of the present invention cannot be attained. The above value of "D+W" determined from a number of samples large enough to be statistically reliable (that is, a satisfactory number of crystal grains) is substantially equal to the value of the average diameter of the crystal grains. Accordingly, in such a case, the value of "average diameter of crystal grains" can be utilized as the value of "D+W."

In the present invention, the above-described "average grain diameter (D)," "average precipitation width (W)," and "D+W" are those determined by observing any desired sectional plane of a high hardness, high corrosion resistance and high wear resistance alloy according to the present invention under an optical microscope, designating 20 crystal grains in total as a sample, measuring the grain diameter and the precipitation width for the selected crystal grains, and determining the average of the measurements to determine D and W and determining D+W based these averages.

In one preferred embodiment of the present invention, the high hardness, high corrosion resistance and high wear resistance alloy according to the present invention comprises not less than 25% by weight and not more than 60% by weight of Cr (chromium) and not less than 1% by weight and not more than 10% by weight of Al (aluminum) with the balance consisting of Ni (nickel), trace elements and incidental impurities. In one further preferred embodiment, the high hardness, high corrosion resistance and high wear resistance alloy according to the present invention comprises not less than 30% by weight and not more than 45% by weight of Cr (chromium) and not less than 2% by weight and not more than 6% by weight of Al (aluminum) with the balance consisting of Ni (nickel), trace elements and incidental impurities.

In a preferred high hardness, high corrosion resistance and high wear resistance alloy according to the present invention, Cr is an element indispensable for ensuring corrosion resistance and workability, and the content of Cr is preferably not less than 25% by weight and not more than 60% by weight.

In a preferred high hardness, high corrosion resistance and high wear resistance alloy according to the present invention, Al is an alloying element that mainly acts on the hardness of the alloy. When the Al content falls within the above-defined range, a necessary level of hardness can be provided.

In a preferred high hardness, high corrosion resistance and high wear resistance alloy according to the present invention, Ni is an alloying element that mainly acts on the corrosion resistance and workability of the alloy and is present as one of balance elements, that is, elements other than Cr and Al, in the high hardness, high corrosion resistance and high wear resistance alloy according to the present invention.

In a preferred high hardness, high corrosion resistance and high wear resistance alloy according to the present invention, a part of Cr is replaced with at least one element selected from Zr (zirconium), Hf (hafnium), V (vanadium), Ta (tantalum), Mo (molybdenum), W (tungsten), and Nb (niobium), provided that the total amount of replacement of Zr, Hf, V, and Nb is not more than 1% by weight, the amount of replacement of Ta is not more than 2% by weight, and the total amount of replacement of Mo and W is not more than 10% by weight. The replacement of a part of Cr with one or at least two elements of Zr (zirconium), Hf (hafnium), V (vanadium), Ta (tantalum), Mo (molybdenum), W (tungsten), and Nb (niobium) can further improve the hardness of the alloy.

Further, in a preferred high hardness, high corrosion resistance and high wear resistance alloy according to the present invention, a part of Al may be replaced with Ti, provided that the total amount of replacement of Ti (titanium) is preferably not more than 1% by weight. This is effective in regulating the hardness of the alloy.

The high hardness, high corrosion resistance and high wear resistance alloy according to the present invention may optionally contain Mg (magnesium). A high hardness, high corrosion resistance and high wear resistance alloy having an Mg content of not more than 0.25% by weight is one preferred embodiment of the present invention.

In the high hardness, high corrosion resistance and high wear resistance alloy according to the present invention, other trace elements and incidental impurities which may be intentionally or unavoidably mixed in the alloy, include, for example, C (carbon), Mn (manganese), P (phosphorous), O (oxygen), S (sulfur), Cu (copper), and Si (silicon). The total amount of these elements is preferably not more than 0.3% by weight.

Unlike the conventional Cr—Al—Ni-base alloy or steel product, the high hardness, high corrosion resistance and high wear resistance alloy according to the present invention is free from the formation of the pores by falling of precipitated carbide particles during polishing and damage to polished face by the fallen particles and thus can be evenly polished, whereby a specular surface can be provided in a short time. Further, three phases of α, γ', and γ in the aged structure are stably precipitated. Therefore, a local battery of α, γ', and γ phases is formed, and the interfacial energy of solid/gas interface is larger than solid/solid interface and solid/liquid interface, and the releasability is improved. Further, regardless of the surface roughness, the releasability is good, and a wear-derived variation in releasability is not significant.

Thus, the present invention can provide a high hardness, high corrosion resistance and high wear resistance alloy possessing corrosion resistance, hardness, wear resistance, releasability, fatigue strength and planishing property.

<High Hardness, High Corrosion Resistance and High Wear Resistance Component>

The high hardness, high corrosion resistance and high wear resistance component according to the present invention is formed of the above high hardness, high corrosion resistance and high wear resistance alloy. The term "component" as used herein refers to not only the so-called "parts," which are incorporated, for example, in machines and apparatuses to function as one constituent part of machines, apparatuses and the like but also to articles which are used solely without combining with other parts or the like.

As described above, the alloy according to the present invention possesses excellent corrosion resistance, hardness and wear resistance and, at the same time, possesses releasability, fatigue strength, and planishing property of the molding face. Accordingly, the high hardness, high corrosion resistance and high wear resistance component according to the present invention is particularly suitable for various applications where such various properties are required. For example, the high hardness, high corrosion resistance and high wear resistance component according to the present invention is particularly suitable in components for molding devices for compressing a raw material such as powder or granules, for example, highly corrosive powder such as acidic powder and alkaline powder, into tablets of pharmaceuticals, quasi-drugs, cosmetics, agricultural chemicals, feeds, foods or the like, for example, a mortar having through-holes corresponding to the shape of tablets and a lower pestle and an upper pestle to be inserted into the through-holes (mortar holes).

Further, the high hardness, high corrosion resistance and high wear resistance component according to the present invention is particularly suitable as components for resin production machines or apparatuses, for example, for resin molding machines. For example, the high hardness, high corrosion resistance and high wear resistance component according to the present invention is particularly suitable as components for machines for molding of resins, for example, (i) general-purpose resins, for example, polyethylenes, polyvinyl chlorides, polystyrenes, and ABS resins, and (ii) engineering plastics, for example, polyamides, polycarbonates, modified polyethylene ethers, polyphenylene sulfides, polyamideimides, polyetherimides, and polyimides. The high hardness, high corrosion resistance and high wear resistance component according to the present invention, even when used for a long period of time in a corrosive environment under high temperature and high pressure conditions in producing high functional resins, is less likely to undergo deformation or wear and has excellent releasability.

<Material for High Hardness, High Corrosion Resistance and High Wear Resistance Alloy>

The present invention also relates to a material for an alloy that can form the above high hardness, high corrosion resistance and high wear resistance alloy by subjecting the material to aging heat treatment.

A specific example of a preferred material for an alloy is a solution treated material having such properties that the intensity ratio as measured by X-ray diffractometry is not more than 5% in terms of $I\gamma'(110)/[I\gamma'(110)+I\alpha(110)+I\gamma(200)+I\gamma'(004)]\times100$ and is not more than 5% in terms of $I\alpha(110)/[I\gamma'(110)+I\gamma'(110)+I\gamma(200)+I\gamma'(004)]\times100$, and the grain diameter is not more than 5 mm.

The material for an alloy according to the present invention is more preferably such that (i) the intensity ratio as measured by X-ray diffractometry is not more than 1% in terms of $I\gamma'(110)/[I\gamma'(110)+I\alpha(110)+I\gamma(200)+I\gamma'(004)]\times100$, (ii) the intensity ratio as measured by X-ray diffractometry is not more than 1% in terms of $I\alpha(110)/[I\gamma'(110)+I\gamma(110)+I\gamma(200)+I\gamma'(004)]\times100$, and (iii) the crystal grain diameter is not more than 2 mm.

The material for an alloy according to the present invention is preferably produced, for example, by forming an ingot of a Cr—Al—Ni-base alloy by a melting process, subjecting the ingot to hot working and cold working, optionally working the material into a suitable shape, and then subjecting the material to solid solution treatment in such a manner that the material is subjected to solid solution heat treatment in an argon or nitrogen atmosphere or under the atmospheric pressure at a suitable temperature for a suitable time (preferably at a temperature of 1000 to 1300° C. for 30 to 120 min) and is then immersed in an oil for quenching.

The aging heat treatment will be described later.

<Production Process of High Hardness, High Corrosion Resistance and High Wear Resistance Alloy>

The process for producing a high hardness, high corrosion resistance and high wear resistance alloy according to the present invention is characterized by subjecting the above material for an alloy to aging heat treatment.

The aging heat treatment adopted in the present invention is preferably carried out at 500 to 850° C., particularly at 600 to 750° C., for 1 to 8 hr, particularly for 3 to 5 hr.

In the present invention, before the aging heat treatment of the material for an alloy, the material is preferably subjected to suitable pretreatment heating. In the present invention, upon the pretreatment heating, in the aging heat treatment, the metal structure can be more homogeneously precipitated. Further, the metal structure precipitation speed can be optimized, and, at the same time, the occurrence of cracks in the interior of the alloy material can be prevented.

Preferred methods of pretreatment heating before the aging heat treatment include (i) a method in which the material is heated to a temperature of 400 to 700° C. at a temperature rise rate of not less than 100° C./hr and not more than 500° C./hr, preferably not less than 100° C./hr and not more than 400° C./hr, and (ii) a method in which the material is kept at a temperature range of 400 to 500° C. for at least 0.5 hr. When the temperature rise rate in the method (i) is lower than 100° C./hr, the property requirements can be satisfied. In this case, however, the necessary treatment time is excessively long and, thus, a temperature rise rate of lower than 100° C./hr is unfavorable from the viewpoint of production. When the temperature rise rate exceeds 500° C./hr, the level of heterogenization of the temperature distribution and the level of volume shrinkage caused by precipitation are excessively high, often leading to cracking. When the holding time in the method (ii) is less than 0.5 hr, the effect of this pretreatment heating is unsatisfactory. The upper limit of the holding time is preferably 5 hr. Even when the heat treatment is carried out for longer than 5 hr, the effect is saturated.

The material for an alloy according to the present invention (the metal crystal in this material for an alloy being composed mainly of an α phase), when subjected to this aging heat treatment, preferably subjected to the above aging heat treatment after the above pretreatment heating, causes precipitation of a mixed phase of (α phase+γ phase+γ phase) to produce the high hardness, high corrosion resistance and high wear resistance alloy according to the present invention. That is, full precipitation of fine crystals of micron size by this aging heat treatment results in the production of an alloy according to the present invention possessing excellent corrosion resistance, hardness, wear resistance, releasability, fatigue strength and planishing property of the molding face.

EXAMPLES

Example 1

A Cr—Al—Ni-base alloy was melted by a vacuum melting method and was casted. This Cr—Al—Ni-base alloy comprised 38.2% by weight of Cr (chromium), 3.78% by weight of Al (aluminum), and 0.012% by weight of Mg (magnesium) with the balance consisting of Ni (nickel) (hereinafter referred to as "alloy A").

The alloy A thus obtained was forged to prepare a round bar having a size of 30 mm in diameter×1000 mm in length. This round bar was subjected to solution treatment in a vacuum heat treatment furnace of which the atmosphere had been brought to an argon atmosphere, at a temperature of 1200° C. for 2 hr. The round bar was then immersed in an oil and was subjected to solution treatment and was cut into a size of 30 mm in diameter×10 mm in length with a water cooled cuter or a wire cutter.

Next, this material was introduced into a vacuum furnace, and the atmosphere in the vacuum furnace was subjected to degassing. The material was then subjected to aging heat treatment in an argon atmosphere at a temperature of 850° C. for 5 hr and was subsequently cooled in an Ar gas over a period of one hr so that the material was cooled to around a temperature of 150° C. Thereafter, the material was taken out of the vacuum furnace to produce a high hardness, high corrosion resistance and high wear resistance alloy according to the present invention. It was confirmed that, in this alloy, no unaged γ phase was observed and, thus, the proportion of the (α phase+γ phase+γ phase) mixed phase was 100% in terms of area ratio. The intensity ratio was measured by X-ray diffractometry in the same manner as described above and was found to be not more than 162% in terms of $I\alpha(110)/[I\gamma(200)+I\gamma'(004)]\times100$.

Upon aging heat treatment, the surface of this material became somewhat cloudy. The material, however, could easily be planished by finish planishing with a polisher.

Examples 2 to 8 and Comparative Examples 1 to 4

High hardness, high corrosion resistance and high wear resistance alloys (Examples 2 to 8) according to the present invention and comparative alloys (Comparative Examples 1 to 4) were produced and were evaluated in the same manner as in Example 1, except that the aging heat treatment temperature was varied as shown in Table 1.

The results were as shown in Table 1.

Each parameter in Table 1 was measured as follows. The intensity ratio as measured by X-ray diffractometry was determined by applying X-ray (CuKα line) to the surface of each alloy and measuring each peak ratio.

The powder adherence was determined as follows. A citric acid hydrate powder was spread between two alloy samples of the upper sample and the lower sample (30 mm in diameter×10 mm in length), and a load of 490 MPa was applied from the top of the assembly. Thereafter, the upper sample was removed, and the area ratio (%) of the powder adhered when the test was carried out with the powder adherence face of the upper sample and the lower sample being placed in the lower position, was determined.

The resin moldability was determined by preparing a mold from an alloy sample, molding the resin using this mold, repeating this work 10000 times, and determined the percentage defective of the molded resins (resin molded products).

The fatigue strength was determined by carrying out a tensile compression fatigue test (repetition frequency not more than 40 Hz) to determine a fatigue strength (MPa) necessary for breaking the sample at $6\times10^6$ cycles. For example, a fatigue strength of 780 MPa means that the sample breaks when the sample is rotarily hammered by $6\times10^6$ times at 780 MPa.

The planishing property was determined by measuring the proportion of defects present on the surface of the sample after planishing to a surface roughness Ra level of not more than 1 μm. In this case, the measurement conforms to the cleanness d (%) specified in attached document 1 in JIS G 0555. Specifically, the measurement was carried out under conditions of d60×400 (number of fields 60 and magnification 400 times).

TABLE 1

| | Alloy component | Solution heat treatment temp., ° C. | Aging temp., ° C. | Aging time, H | Area ratio of precipitated layer, % | D, μm | D + W, μm | X-ray intensity ratio of alloy*1, % | Releasability: Powder adherence*2, % | Releasability: Resin moldability*3, % | Fatigue strength*4, MPa | Planishing property*5, % |
|---|---|---|---|---|---|---|---|---|---|---|---|---|
| Ex. 1 | A | 1200 | 850 | 5 | 100 | 0 | — | 162 | 2.0 | 0.01 | 780 | 0.065 |
| Ex. 2 | A | 1200 | 800 | 5 | 100 | 0 | — | 172 | 2.3 | 0.02 | 750 | 0.045 |
| Ex. 3 | A | 1200 | 750 | 5 | 100 | 0 | — | 150 | 0.9 | 0.01 | 660 | 0.008 |
| Ex. 4 | A | 1200 | 700 | 5 | 100 | 0 | — | 143 | 1.9 | 0.01 | 510 | 0.021 |
| Ex. 5 | A | 1200 | 650 | 5 | 100 | 0 | — | 117 | 0.7 | 0.02 | 410 | 0.015 |
| Ex. 6 | A | 1200 | 600 | 5 | 99 | 100 | 1050 | 128 | 1.7 | 0.03 | 360 | 0.023 |
| Ex. 7 | A | 1200 | 550 | 5 | 97 | 120 | 1080 | 70 | 2.2 | 0.01 | 320 | 0.043 |
| Ex. 8 | A | 1200 | 500 | 5 | 96 | 200 | 1110 | 55 | 3.4 | 0.05 | 290 | 0.058 |
| Comp. Ex. 1 | A | 1200 | 450 | 5 | 73 | 520 | 1120 | 12 | 7.8 | 0.15 | 170 | 0.105 |
| Comp. Ex. 2 | A | 1200 | 400 | 5 | 35 | 850 | 1100 | 3 | 11.6 | 0.20 | 150 | 0.155 |
| Comp. Ex. 3 | A | 1200 | 350 | 5 | 15 | 990 | 1130 | 0 | 15.4 | 0.22 | 180 | 0.222 |
| Comp. Ex. 4 | A | 1200 | 300 | 5 | 12 | 1020 | 1100 | 0 | 16.2 | 0.20 | 200 | 0.243 |

X-ray intensity ratio of alloy*1: $I\alpha(110)/[I\gamma(200) + I\gamma'(004)] \times 100$ Powder adherence*2: Adherence amount/compressed powder amount (%) (citric acid used) in compression test Resin moldability*3: Percentage defective of resin molding (%) (10000-time test)

Fatigue strength*4: Strength at cycles to failure $6 \times 19^6$

Planishing property*5: Cleanness d (%) specified in JIS G 0555

Examples 9 to 11 and Comparative Examples 5 to 9

High hardness, high corrosion resistance and high wear resistance alloys (Examples 9 to 11) according to the present invention and comparative alloys (Comparative Examples 5 to 9) were produced and were evaluated in the same manner as in Example 1, except that a Cr—Al—Ni-base alloy comprising 38.1% by weight of Cr, 3.79% by weight of Al, and 0.001% by weight of Mg with the balance consisting of Ni (hereinafter referred to as "alloy B") was used instead of "alloy A" and the conditions were changed as shown in Table 2. The results were as shown in Table 2.

TABLE 2

| | Alloy component | Solution heat treatment temp., ° C. | Aging temp., ° C. | Aging time, H | Area ratio of precipitate layer, % | D, μm | D + W, μm | X-ray intensity ratio of alloy, % | Releasability: Powder adherence, % | Releasability: Resin moldability, % | Fatigue strength, MPa | Planishing property, % |
|---|---|---|---|---|---|---|---|---|---|---|---|---|
| Ex. 9 | B | 1200 | 850 | 5 | 100 | 0 | — | 155 | 2.3 | 0.02 | 720 | 0.032 |
| Ex. 10 | B | 1200 | 800 | 5 | 100 | 0 | — | 132 | 2.0 | 0.05 | 610 | 0.017 |
| Ex. 11 | B | 1200 | 750 | 5 | 98 | 110 | 1080 | 96 | 2.5 | 0.06 | 390 | 0.025 |
| Comp. Ex. 5 | B | 1200 | 700 | 5 | 76 | 520 | 1100 | 42 | 8.5 | 0.23 | 190 | 0.124 |
| Comp. Ex. 6 | B | 1200 | 650 | 5 | 68 | 590 | 1030 | 34 | 10.3 | 0.27 | 180 | 0.203 |
| Comp. Ex. 7 | B | 1200 | 600 | 5 | 63 | 610 | 1000 | 38 | 14.2 | 0.62 | 190 | 0.135 |
| Comp. EX. 8 | B | 1200 | 550 | 5 | 56 | 720 | 1050 | 27 | 13.7 | 0.53 | 180 | 0.168 |
| Comp. Ex. 9 | B | 1200 | 500 | 5 | 44 | 790 | 1100 | 36 | 14.5 | 0.68 | 210 | 0.208 |

Examples 12 to 14 and Comparative Examples 10 to 14

High hardness, high corrosion resistance and high wear resistance alloys (Examples 12 to 14) according to the present invention and comparative alloys (Comparative Examples 10 to 14) were produced and were evaluated in the same manner as in Example 1, except that the solution treatment temperature and the aging heat treatment temperature were varied as shown in Table 3.

The results were as shown in Table 3.

TABLE 3

| | Alloy component | Solution heat treatment temp., ° C. | Aging temp., ° C. | Aging time, H | Area ratio of precipitate layer, % | D, μm | D + W, μm | X-ray intensity ratio of alloy*3, % | Releasability: Powder adherence, % | Releasability: Resin moldability, % | Fatigue strength, MPa | Planishing property, % |
|---|---|---|---|---|---|---|---|---|---|---|---|---|
| Ex. 12 | A | 1300 | 850 | 5 | 100 | 0 | — | 179 | 2.4 | 0.02 | 760 | 0.018 |
| Ex. 13 | A | 1300 | 800 | 5 | 98 | 210 | 1890 | 134 | 3.8 | 0.03 | 670 | 0.021 |
| Ex. 14 | A | 1300 | 750 | 5 | 96 | 320 | 1960 | 88 | 3.1 | 0.06 | 450 | 0.036 |
| Comp. Ex. 10 | A | 1300 | 700 | 5 | 80 | 720 | 2110 | 45 | 9.3 | 0.43 | 200 | 0.142 |
| Comp. Ex. 11 | A | 1300 | 650 | 5 | 62 | 1140 | 2040 | 34 | 12.6 | 0.46 | 180 | 0.293 |
| Comp. Ex. 12 | A | 1300 | 600 | 5 | 44 | 1480 | 2080 | 27 | 22.1 | 0.52 | 190 | 0.224 |
| Comp. Ex. 13 | A | 1300 | 550 | 5 | 37 | 1660 | 2160 | 38 | 18.3 | 0.63 | 170 | 0.241 |
| Comp. Ex. 14 | A | 1300 | 500 | 5 | 34 | 1710 | 2090 | 31 | 20.1 | 0.48 | 190 | 0.261 |

Examples 15 to 30

High hardness, high corrosion resistance and high wear resistance alloys (Examples 15 to 30) according to the present invention were produced using the same alloy component as in Example 1 and were evaluated in the same manner as in Example 1, except that, prior to the aging heat treatment, pretreatment heating shown in Table 4 or 5 was carried out. The results were as shown in Tables 4 and 5.

TABLE 4

| | Alloy component | Solution heat treatment temp., ° C. | Aging temp., ° C. | Aging time, H | Heating as pretreatment (i): Temp., ° C. | Heating as pretreatment (i): Temp. rise rate, ° C./H | Area ratio of precipitate layer, % | D, μm | D + W, μm | X-ray intensity ratio of alloy, % | Releasability: Powder adherence, % | Releasability: Resin moldability, % | Fatigue strength, MPa | Planishing property, % |
|---|---|---|---|---|---|---|---|---|---|---|---|---|---|---|
| Ex. 15 | A | 1200 | 850 | 5 | 600 | 400 | 100 | 0 | — | 162 | 2.0 | 0.01 | 780 | 0.065 |
| Ex. 16 | A | 1200 | 800 | 5 | 600 | 300 | 100 | 0 | — | 172 | 2.3 | 0.02 | 750 | 0.045 |
| Ex. 17 | A | 1200 | 750 | 5 | 600 | 300 | 100 | 0 | — | 150 | 0.9 | 0.01 | 660 | 0.008 |
| Ex. 18 | A | 1200 | 700 | 5 | 600 | 300 | 100 | 0 | — | 143 | 1.9 | 0.01 | 510 | 0.021 |
| Ex. 19 | A | 1200 | 650 | 5 | 600 | 300 | 100 | 0 | — | 117 | 0.7 | 0.02 | 410 | 0.015 |
| Ex. 20 | A | 1200 | 600 | 5 | 600 | 300 | 99 | 100 | 1050 | 128 | 1.7 | 0.03 | 360 | 0.023 |
| Ex. 21 | A | 1200 | 550 | 5 | 550 | 200 | 97 | 120 | 1080 | 70 | 2.2 | 0.01 | 320 | 0.043 |
| Ex. 22 | A | 1200 | 500 | 5 | 500 | 200 | 96 | 200 | 1110 | 55 | 3.4 | 0.05 | 290 | 0.058 |

TABLE 5

| | Alloy component | Solution heat treatment temp., ° C. | Aging temp., ° C. | Aging time, H | Heating as pretreatment (ii): Temp., ° C. | Heating as pretreatment (ii): Temp, holding time, H | Area ratio of precipitate layer, % | D, μm | D + W, μm | X-ray intensity ratio of alloy, % | Releasability: Powder adherence, % | Releasability: Resin moldability, % | Fatigue strength, MPa | Planishing property, % |
|---|---|---|---|---|---|---|---|---|---|---|---|---|---|---|
| Ex. 23 | A | 1200 | 850 | 5 | 500 | 0.5 | 100 | 0 | — | 172 | 1.8 | 0.02 | 780 | 0.062 |
| Ex. 24 | A | 1200 | 800 | 5 | 500 | 0.5 | 100 | 0 | — | 170 | 2.1 | 0.01 | 740 | 0.042 |
| Ex. 25 | A | 1200 | 750 | 5 | 500 | 1.0 | 100 | 0 | — | 155 | 1.2 | 0.01 | 660 | 0.009 |
| Ex. 26 | A | 1200 | 700 | 5 | 500 | 1.0 | 100 | 0 | — | 145 | 1.5 | 0.02 | 520 | 0.020 |
| Ex. 27 | A | 1200 | 650 | 5 | 500 | 0.5 | 100 | 0 | — | 142 | 1.0 | 0.02 | 420 | 0.016 |
| Ex. 28 | A | 1200 | 600 | 5 | 500 | 0.5 | 100 | 90 | 1050 | 135 | 1.8 | 0.02 | 350 | 0.022 |

TABLE 5-continued

| | Alloy component | Solution heat treatment temp., ° C. | Aging temp., ° C. | Aging time, H | Heating as pretreatment (ii) Temp., ° C. | Heating as pretreatment (ii) Temp, holding time, H | Area ratio of precipitate layer, % | D, μm | D + W, μm | X-ray intensity ratio of alloy, % | Releasability Powder adherence, % | Releasability Resin moldability, % | Fatigue strength, MPa | Planishing property, % |
|---|---|---|---|---|---|---|---|---|---|---|---|---|---|---|
| Ex. 29 | A | 1200 | 550 | 5 | 450 | 0.5 | 98 | 100 | 1070 | 72 | 2.1 | 0.02 | 310 | 0.041 |
| Ex. 30 | A | 1200 | 500 | 5 | 400 | 0.5 | 98 | 180 | 1110 | 60 | 3.1 | 0.04 | 290 | 0.054 |

Figure 2:
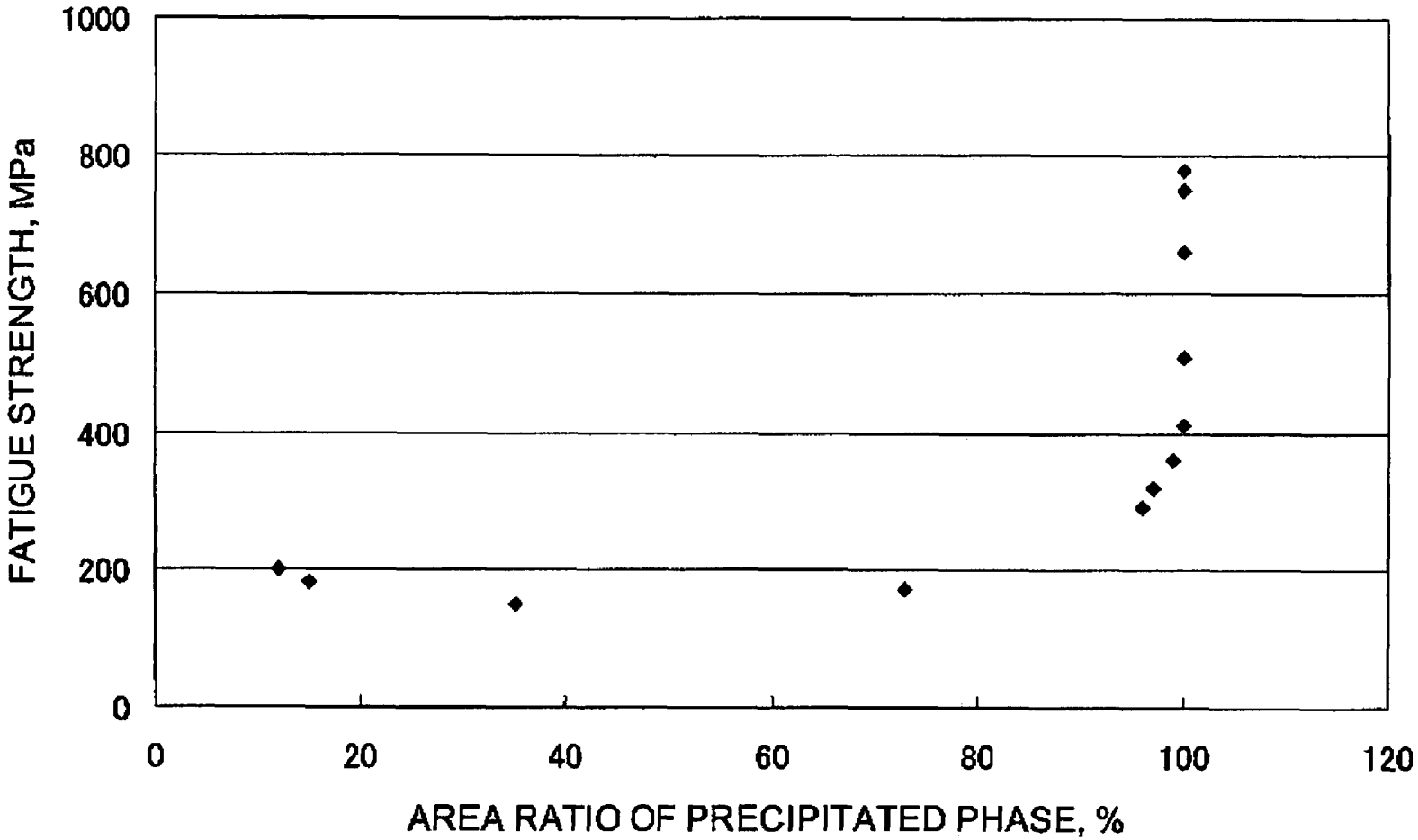
FIG. 2 A diagram showing the relationship between the area ratio of a mixed phase of ($\alpha$ phase+$\gamma$ phase+$\gamma$ phase) in an alloy and the fatigue strength.
Figure 3:
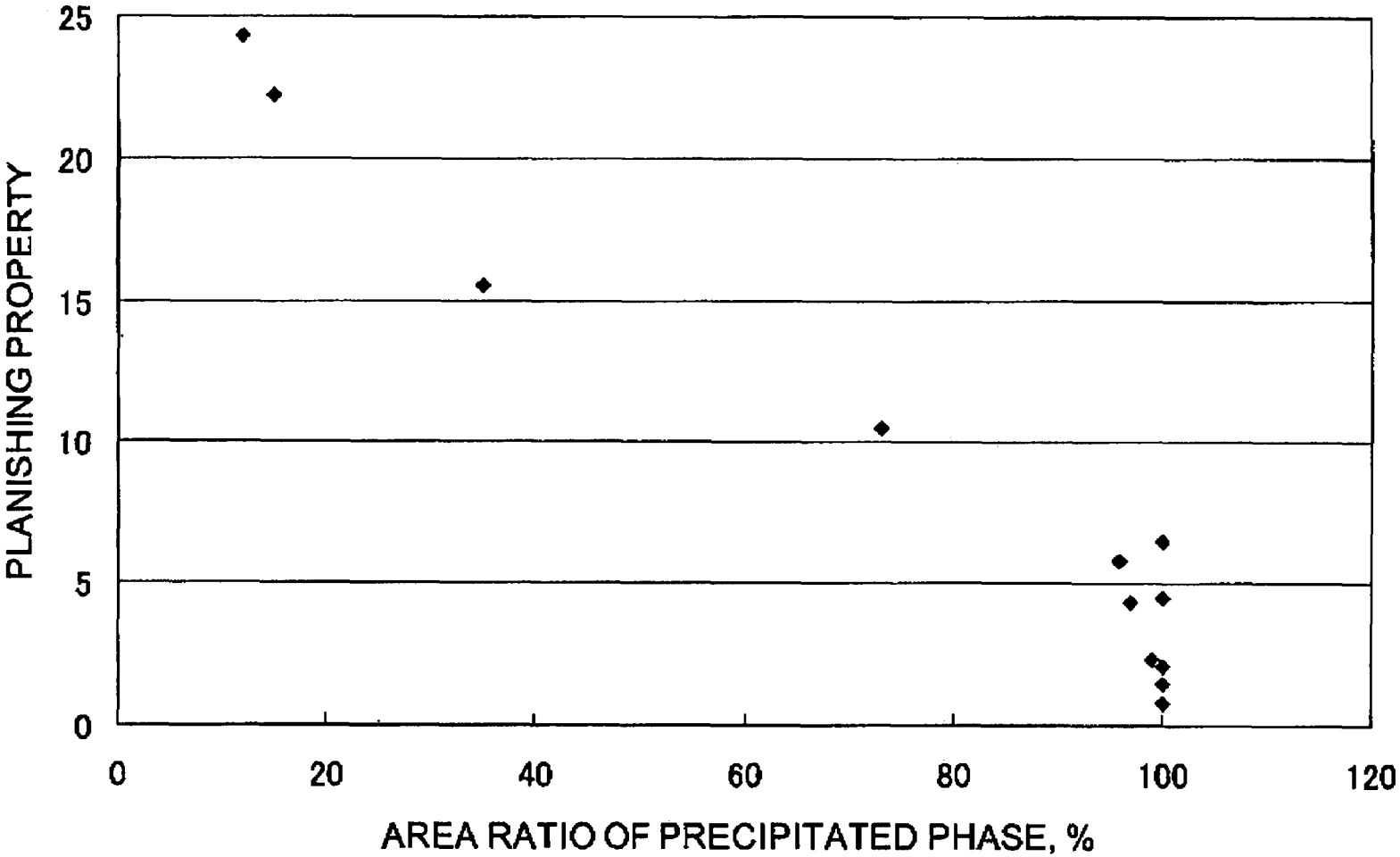
FIG. 3 A diagram showing the relationship between the area ratio of a mixed phase of (α phase+γ phase+γ phase) in an alloy and the planishing property.
Figure 4:
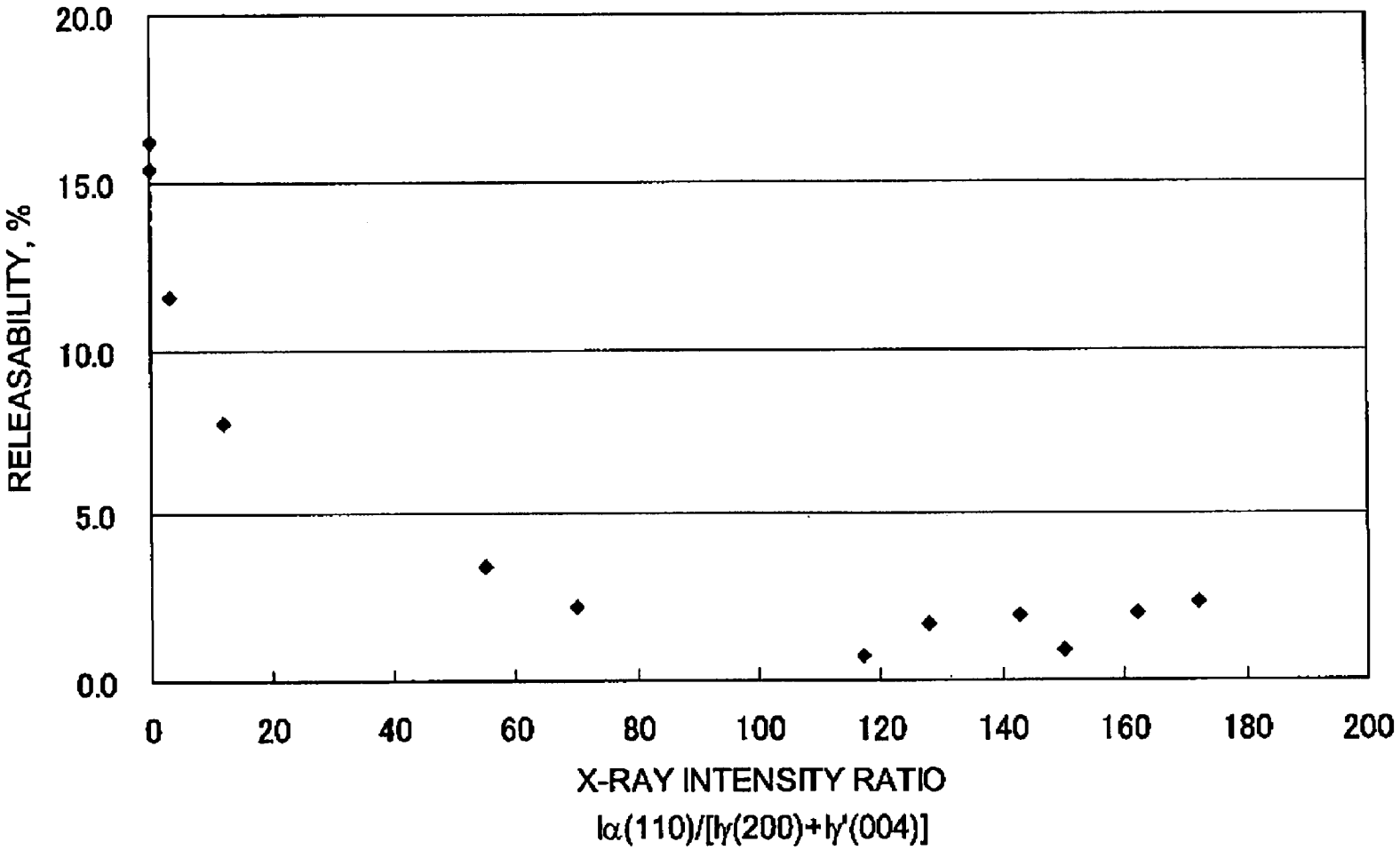
FIG. 4 A diagram showing the relationship between the intensity ratio for an alloy as measured by X-ray diffractometry and the releasability.
Figure 5:
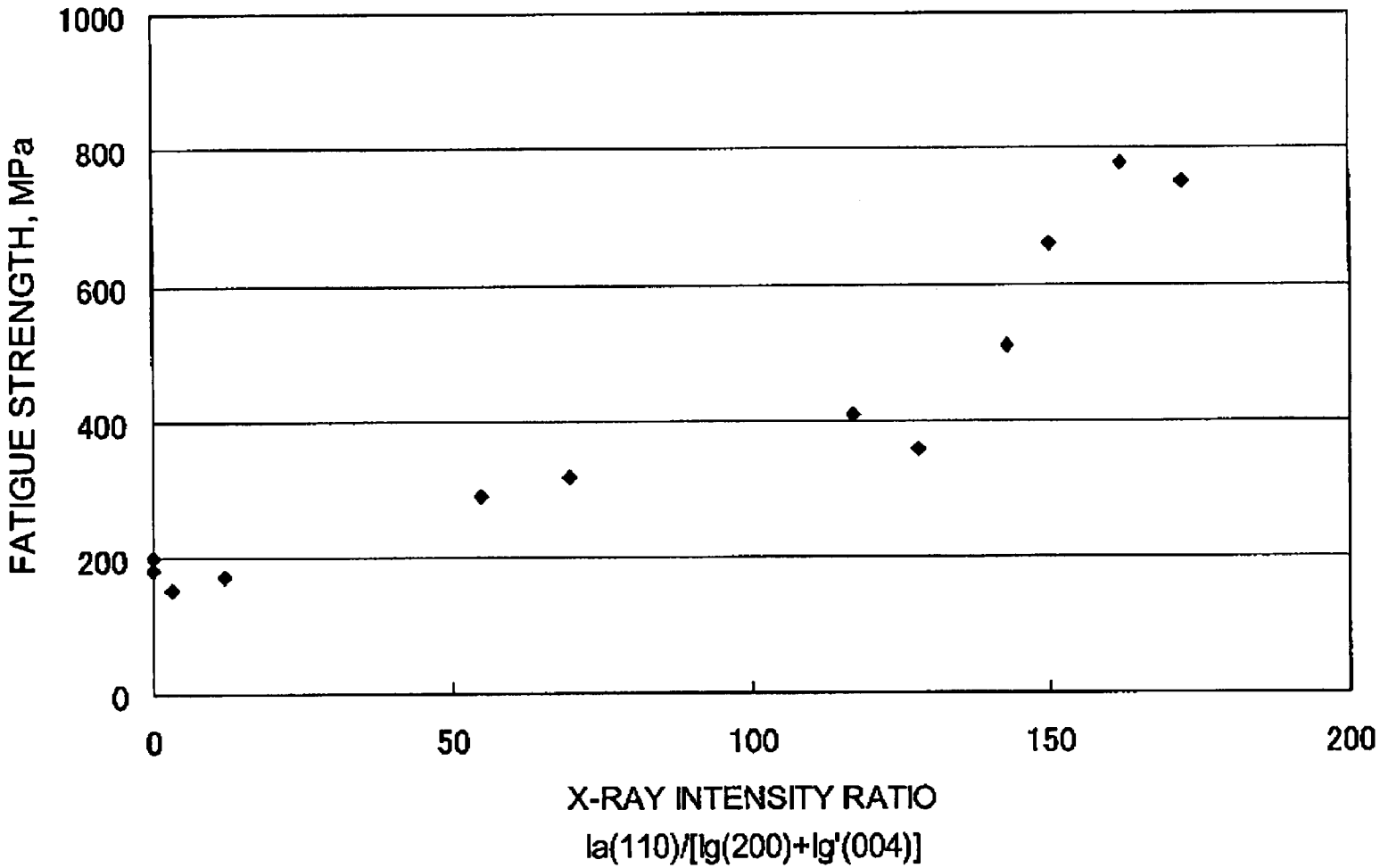
FIG. 5 A diagram showing the relationship between the intensity ratio for an alloy as measured by X-ray diffractometry and the fatigue strength.
Figure 6:
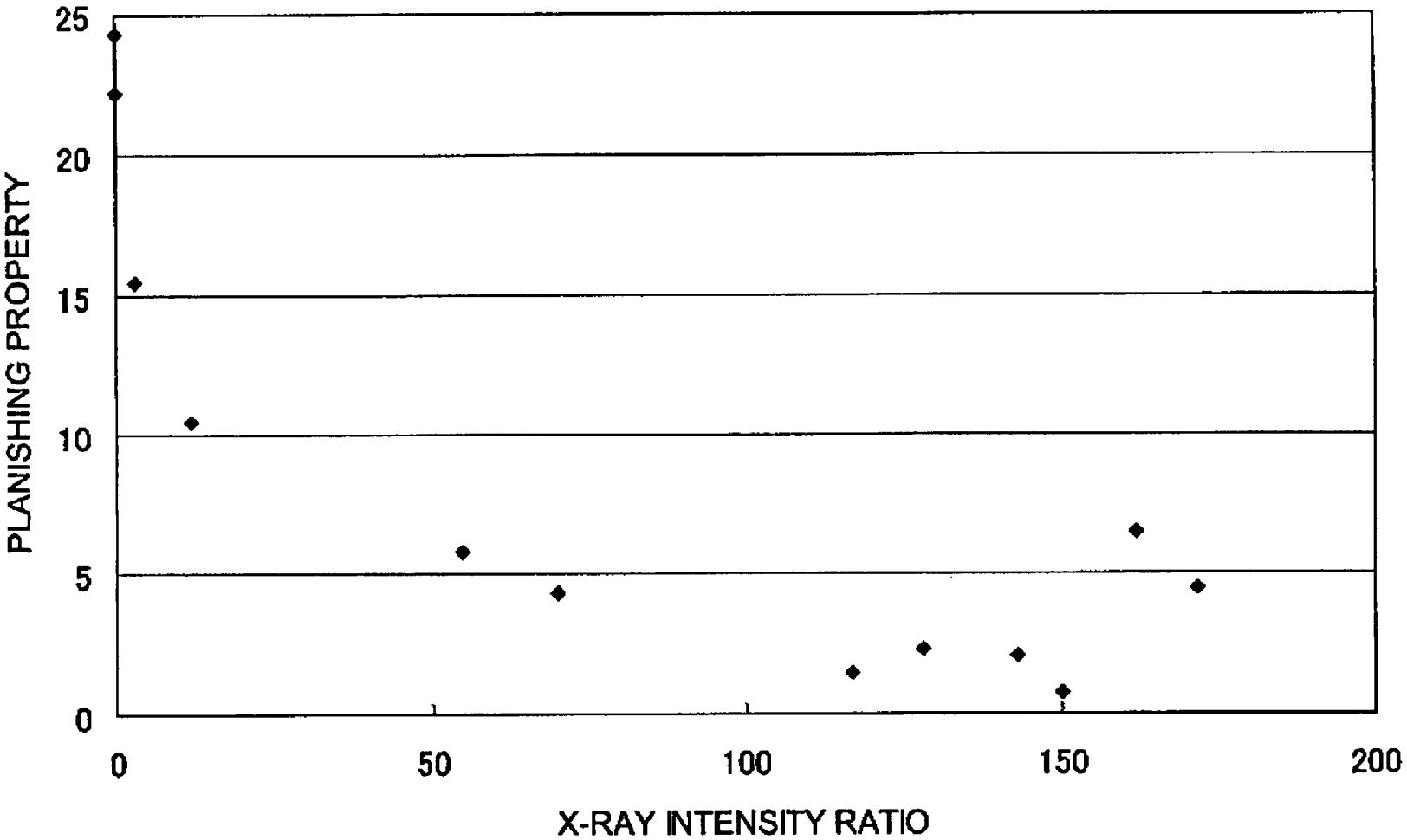
FIG. 6 A diagram showing the relationship between the intensity ratio for an alloy as measured by X-ray diffractometry and the planishing property.
Figure 7:
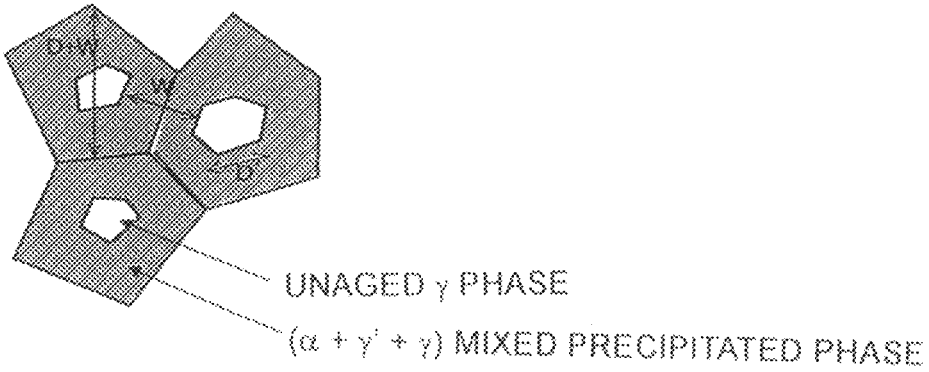
FIG. 7 A typical view of a metal structure in a cross section of a high hardness, high corrosion resistance and high wear resistance alloy according to the present invention.

Based on data obtained in Examples 1 to 14 and Comparative Examples 1 to 10, (i) the relationship between the area ratio of (α phase+γ phase+γ phase) mixed phase and the releasability, fatigue strength, and planishing property was determined (FIGS. 1 to 3), and (ii) the relationship between the X-ray intensity and the releasability, fatigue strength, and planishing property was determined (FIG. 4 to FIG. 6).

As can be seen from data shown in Tables 1 to 5 and FIGS. 1 to 6, corrosion resistant alloys having excellent releasability, fatigue strength, and planishing property could be obtained when the proportion of a mixed phase of (α phase+γ phase+γ phase) is not less than 95% in terms of area ratio, and the intensity ratio as measured by X-ray diffractometry is not less than 50% and not more than 200% in terms of Iα(110)/[Iγ(200)+Iγ'(004)]×100.

The invention claimed is:

1. A process for producing a high hardness, high corrosion resistance and high wear resistance alloy, said process comprising the steps of:

forming a Cr(chromium)-Al(aluminum)-Ni(nickel)-base alloy material by a melting process;

subjecting the material to hot working and cold working;

subjecting the material to solid solution treatment in such a manner that the material is subjected to solid solution heat treatment and then immersed in an oil for quenching; and subjecting the material to aging heat treatment to form an alloy so that the proportion of a mixed phase of (α phase+γ' phase+γ phase) precipitated at grain boundaries of γ phase grains in a metal structure in the cross section of the alloy is not less than 95% in terms of area ratio, and the intensity ratio as measured by X-ray diffractometry of the alloy is not less than 50% and not more than 200% in terms of Iα(110)/[Iy(200)+Iγ'(004)]×100, wherein the aging heat treatment is carried out at 500 to 850° C., and wherein, prior to the aging heat treatment, said material is subjected to (i) pretreatment heating in which the material is heated to 400 to 700° C. at a temperature rise rate of not less than 100° C./hr and not more than 500° C./hr and (ii) pretreatment heating in which the material is held in a temperature range of 400 to 500° C. for at least 0.5 hr.

* * * * *